US005937473A

United States Patent [19]

Lisowski

[11] Patent Number: 5,937,473

[45] Date of Patent: Aug. 17, 1999

[54] INTAKE CLEARING TOOL FOR JET-POWERED AQUATIC VEHICLES

[76] Inventor: Walter E. Lisowski, 3523 N. Kenton Ave., Chicago, Ill. 60641

[21] Appl. No.: 08/870,874

[22] Filed: Jun. 6, 1997

Related U.S. Application Data

[60] Provisional application No. 60/039,097, Feb. 24, 1997.

[51] Int. Cl.[6] ..... B08B 9/02

[52] U.S. Cl. ..... 15/236.08; 15/104.05; 15/104.16; 15/143.1; 56/400.17; 56/400.21

[58] Field of Search ..... 15/104.05, 104.16, 15/143.1, 144.3, 144.4, 145, 236.01, 236.08; 16/114 R; 56/400.01, 400.17, 400.21; 172/378, 380; 294/55.5

[56] References Cited

U.S. PATENT DOCUMENTS

| | | | |
|---|---|---|---|
| 1,629,900 | 5/1927 | Youngman | 15/104.16 |
| 1,749,103 | 3/1930 | Kortick | 15/236.08 |
| 1,902,705 | 3/1933 | Kee | 294/5.5 |
| 2,237,969 | 4/1941 | Olsen | 15/143.1 |
| 2,536,607 | 1/1951 | Jenkins | 15/144.4 |
| 2,624,061 | 1/1953 | Leas | 15/145 |
| 2,993,222 | 7/1961 | Laymon | 15/145 |
| 3,091,790 | 6/1963 | Schroeder | 15/144.4 |
| 5,133,101 | 7/1992 | Hauser et al. | 15/143.1 |
| 5,343,587 | 9/1994 | Findley | 15/144.4 |

FOREIGN PATENT DOCUMENTS

| | | | |
|---|---|---|---|
| 1600603 | 10/1981 | United Kingdom | 56/400.21 |

*Primary Examiner*—Terrence R. Till
*Attorney, Agent, or Firm*—Leydig, Voit & Mayer, Ltd.

[57] ABSTRACT

An intake clearing tool for jet-powered aquatic vehicles has an elongated handle portion, attachment means at one end for receiving a complementary attachable finger-type rake head and a handle grip at the opposite end. The handle grip end is adapted to receive a 90° extension handle to enable the rake tool to be manipulated from alongside or on board a vehicle. In the preferred embodiment, the elongated handle is extensible and includes a first part which is sealed at both ends to contain an air chamber therein so that the handle will be capable floating rather than sinking. The handle portion preferably made of at least two tubular plastic telescoping rods has an attachment means at one end preferably in the form of screw threads that receives a rake tool head with a corresponding screw attachment and the opposite end has a resilient handle grip that may include an over-the-wrist securing loop. The rake head attachment has substantially v-shaped and barb tipped fingers that are perpendicularly disposed. An interlocking mechanism secures the telescoping rod members in their extended position against both collapsing and rotation. An end plug on the inner rod member is provided with an o-ring seal and the outer end of the outer rod has a flap valve such that the telescoping action of the rods forms a pump that may be used to remove water from a compartment. An alternative form has tubular metal rods that fit together with spring biased lock pins.

6 Claims, 11 Drawing Sheets

INTAKE CLEARING TOOL FOR JET-POWERED AQUATIC VEHICLES

CROSS REFERENCE

Priority is claimed on my U.S. Provisional application Ser. No. 60/039,097, filed Feb. 24, 1997, entitled: "Intake Cleaning Tool for Jet-Powered Aquatic Vehicles."

FIELD OF THE INVENTION

The present invention relates generally to tools for performing clearing operations on aquatic vehicles and more particularly to tools for clearing intakes on jet-powered aquatic vehicles.

BACKGROUND OF THE INVENTION

With the increasing popularity of water jet-powered skis or wave runners and small boats, a problem that has surfaced is that the intakes can become clogged with water grass, sea weed or other debris present in the water. In the case of the larger jet-powered vehicles the intakes are not readily accessible to clear them without diving underneath the vehicle or lifting the vehicle out of the water.

Various proposals and attempts have been made to provide specialty tools that can be manipulated from alongside or while aboard the vehicle to clear the intake. However, such tools have suffered from a variety of deficiencies due to their single purpose use and/or awkward construction from the standpoint of storage and handleability as well as not providing sufficient versatility or more useful applications to the water vehicle operator.

BRIEF SUMMARY OF THE INVENTION

Accordingly, it is a primary object of the invention to provide a universally-applicable tool which can clear intakes of jet-powered water vehicles and that does overcome all of the problems of previous devices as well as providing a device that is convenient to use and store.

It is also an object of the invention to provide a clearing tool that adjusts to a wide variety of different jet-powered aquatic vehicles of different sizes and types.

It is a further object of the invention to provide a jet intake clearing tool that can be manipulated from alongside as well as from onboard the vehicle.

It is still another object of the invention to provide a jet intake clearing tool which collapses to form a compact device that is easy to assemble and store.

It is yet another object of the invention to provide a tool of the foregoing type that will take different clearing heads for performing a number of different clearing operations.

It is still another object of the invention to provide a tool of the foregoing type that can float so as not to become lost due to sinking to the bottom when dropped.

It is still further object of the invention to provide a device that has additional functions to enhance its use and value to the user.

In accordance with these and other objects of the invention, there is provided an elongated preferably extensible handle portion that has attachment means at one end for receiving a complementary attachable finger-type rake head. The opposite end of the handle is adapted to receive a 90° extension handle so as to enable the tool with the rake head attached to be manipulated from alongside or on board a vehicle for clearing the intake of a jet-powered aquatic vehicle.

According to the preferred embodiment of the invention, the elongated handle includes a first part which is sealed at both ends to contain an air chamber therein so that the handle will be capable floating rather than sinking. The handle portion is preferably made of at least two tubular plastic telescoping rods with one end having an attachment means preferably in the form of screw threads that receives a tool such as a fingered-rake head with a corresponding screw attachment and the opposite end having a resilient handle grip that may further include an over-the-wrist securing loop. An interlocking mechanism is provided to secure the telescoping rod members in their extended position against both collapsing and rotation. An end plug on the inner rod member is provided with an o-ring seal and the outer end of the outer rod has a flap valve such that the telescoping action of the rods forms a pump that may be used to remove water from a compartment. These and other advantages of the invention will be discussed in greater detail in the specification which follows.

BRIEF DESCRIPTION OF THE DRAWINGS

The invention will be described in reference to certain preferred embodiments as shown in the attached drawings wherein.

DESCRIPTION OF THE PREFERRED EMBODIMENTS

While the invention will be described in reference to the preferred embodiments, it will be obvious to those of ordinary skill in the art that variations of these preferred embodiments may be used and it is intended that the invention may be practiced otherwise then as specifically described herein.

Figure 1:
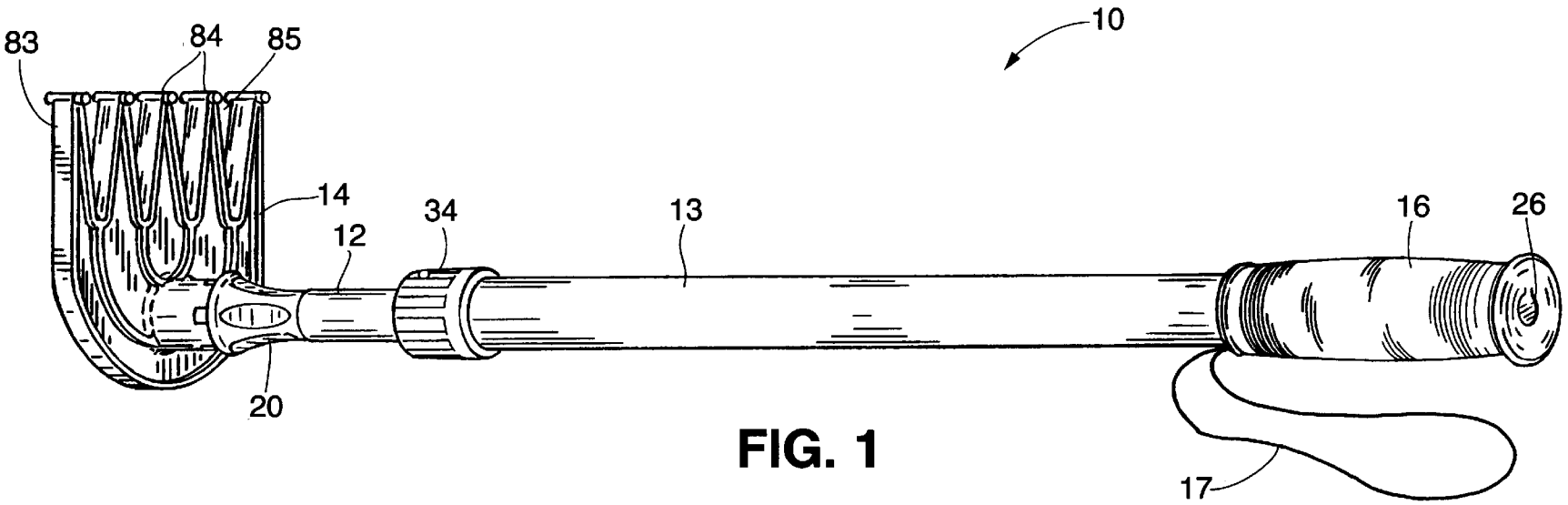
FIG. 1 is a perspective view of an exemplary intake clearing tool which has a rake finger head at one end in accordance with the present invention.
Figure 2:
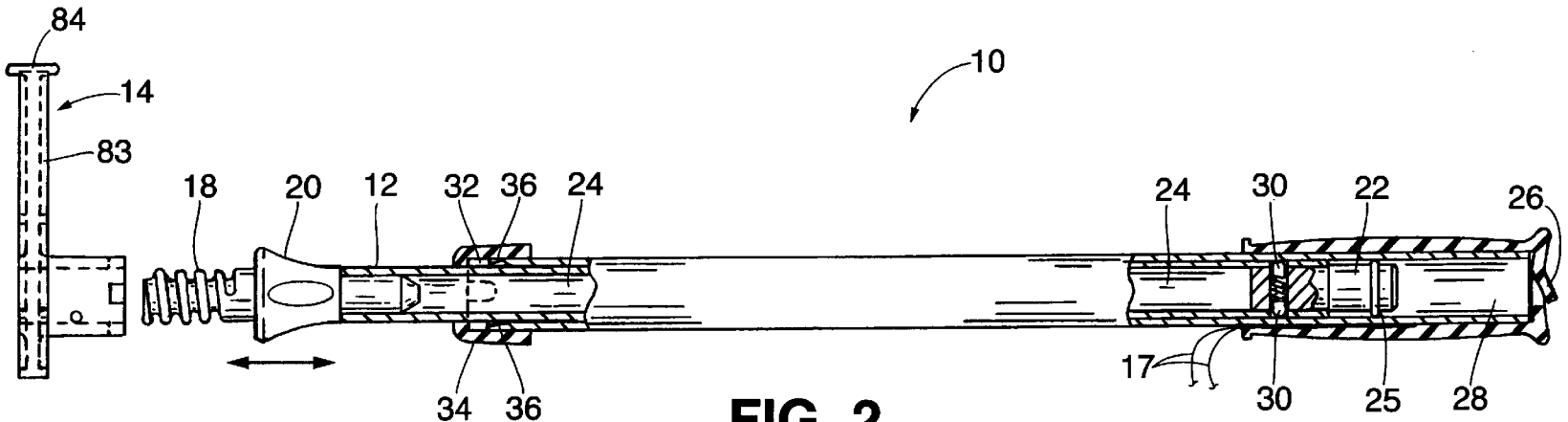
FIG. 2 is a side view of the tool with portions broken away and the rake attachment exploded alongside.

Referring now to FIG. 1, there is illustrated a clearing tool for the intake of a jet-powered aquatic vehicle, generally indicated at 10, which includes a two-part telescopic rod 12, 13 having a fingered rake tool attachment 14 at one end and a handle grip 16 at the other end together with a wrist loop 17. The tool attachment end of rod 12, as seen in FIG. 2, has a threaded end attachment member 18 that receives the rake head tool 14. It will be appreciated that other types of tools such as brushes, scrapers, squeegees may be provided and utilized in place of the rake finger tool attachment.

As shown in FIG. 2, the inner extensible tube member 12 is sealed at both ends by attachment plug 20 and sealing plug 22 so that there is a entrapped chamber of air in the tool. This filled air chamber 24 provides enough buoyancy that the tool will float rather than sink if dropped into the water. The sealing plug 22 is provided with an o-ring 25 that engages with the inner surface of the outer telescoping rod 13 and the handle sleeve 16 at the outer end of the outer rod 13 covers the open end. The cap end of the handle 16 is provided with a integral flap valve 26 to ordinarily keep water from entering the handle chamber 28 when the rods are extended. However, if the rods are moved to the extended position while the handle portion with its flap valve are held submerged the suction action will pull water up into the chamber 28. Then the compression of the rods 12, 13 will force the water back out the flap valve 26 thereby enabling the tool to be used as a bilge-type pump.

Figure 7:
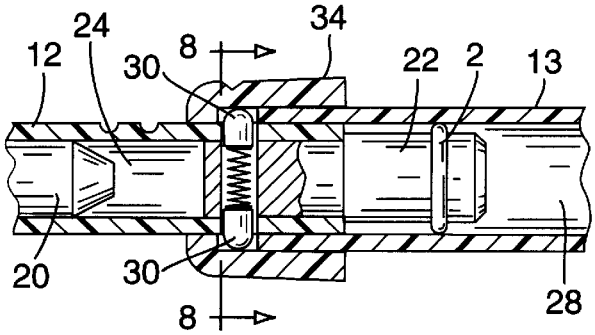
FIG. 7 is a longitudinal section of the extension connection shown in FIG. 6.
Figure 8:
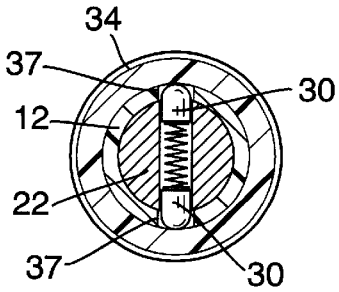
FIG. 8 is a section taken along the line 8—8 in FIG. 7.
Figure 9:
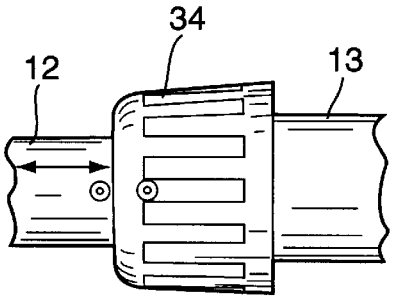
FIG. 9 is a partial side view of the extension connection of the handle in the unlocked position.
Figure 10:
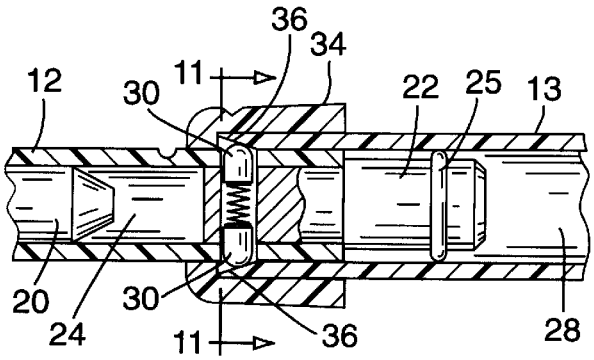
FIG. 10 is a longitudinal section of the extension connection shown in FIG. 9.
Figure 11:
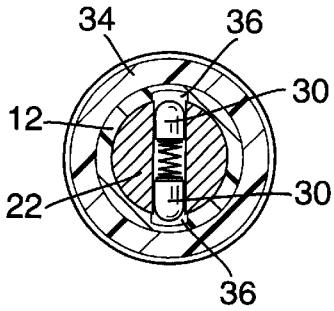
FIG. 11 is a section taken along the line 11—11 in FIG. 10.

In order to lock the rods 12, 13 in the extended position, referring to FIGS. 6–11, there is provided a pair of spring biased pins 30 that serve to hold the sealing plug 22 with respect to the inner rod 12 member as well. The ends of the pins 30 co-act with an annular groove 32 formed between the sleeve cap 34 at the end wall of the adjacent end of the outer rod 13. A pair of camming ramps 36 formed in the inner surface of the outer rod end 13 allow the spring pins 30 to be collapsed when the rods are positioned in either of two 180° apart angularly oriented positions as shown in FIG. 10. A pair of receiving slots 37 at 90° angular positions with respect to the ramps 36 serve to lock the tubes 12, 13 against rotation by a twist and compressing action between the rods as shown in FIGS. 7–8. A slight pull apart of the rods releases the locking action and then twisting them again by 90° allows the rods to be fully compressed to a collapsed position.

Figure 12:
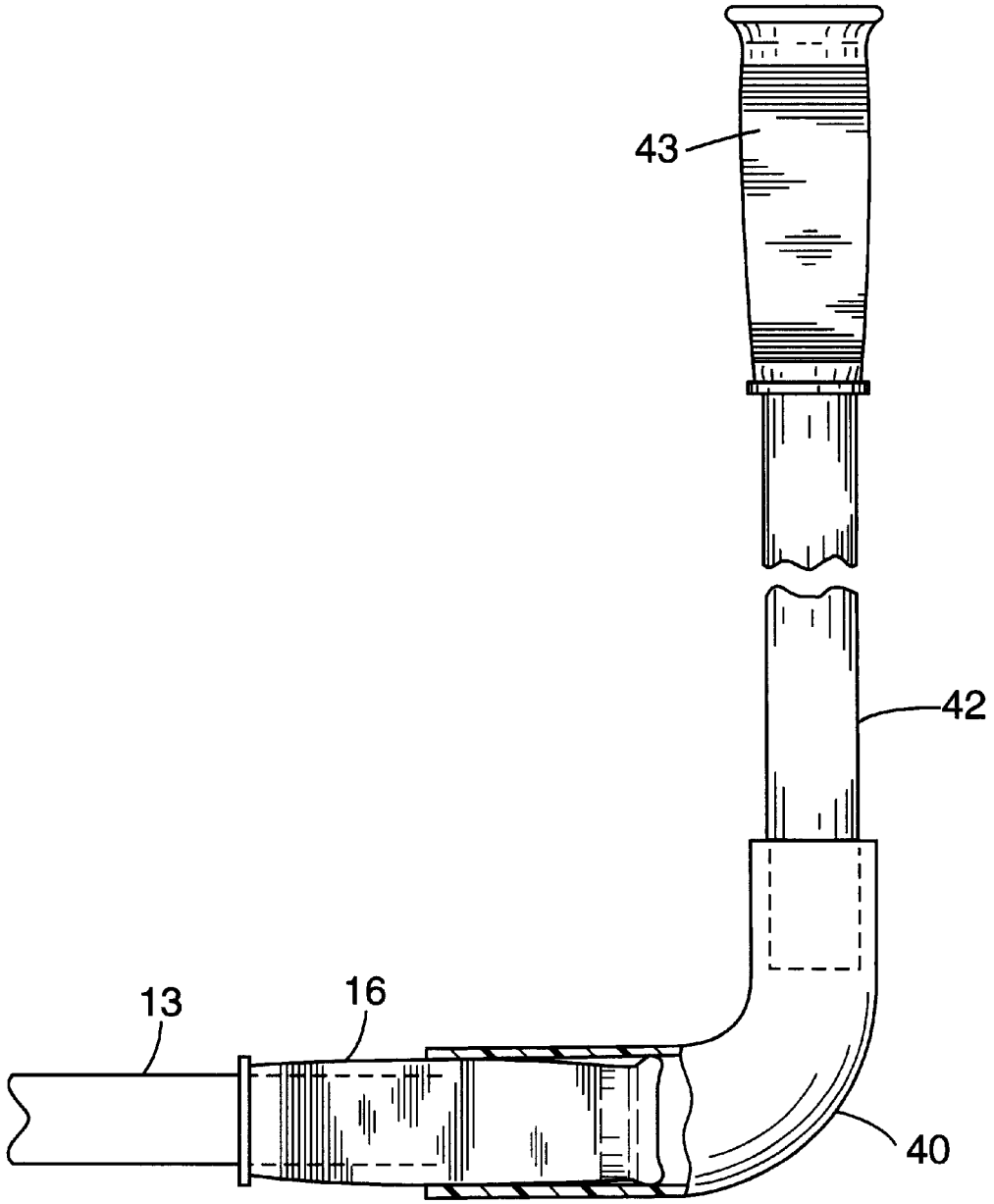
FIG. 12 is a side view of an angular extension for the tools.

In accordance with another aspect of the present invention, referring to FIG. 12, a 90° adapter 40 with an extension handle 42 that may likewise be collapsible or unitary can be fitted over the handle end 16 of the tool so that the intake clearing or clearing action can be performed off the side of a vehicle or even on board the vehicle without entering the water. The handle 42 has a resilient handle grip 43 similar to grip 16.

Figure 13:
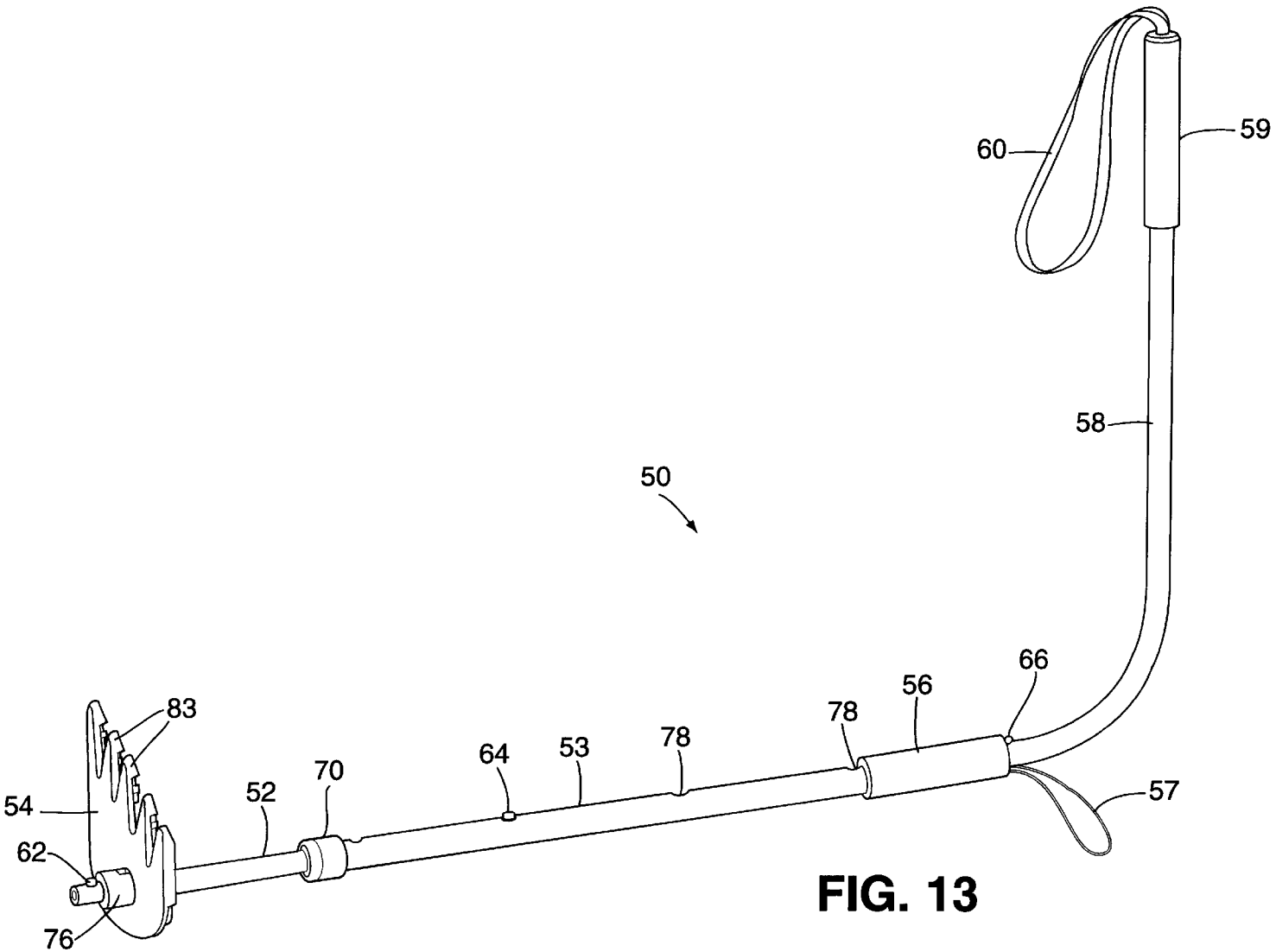
FIG. 13 is a perspective view of another embodiment of intake clearing tool which has a rake finger head at one end.

Referring to FIG. 13, there is shown an alternative embodiment of a clearing tool for the intake of a jet powered aquatic vehicle generally indicated at 50, which includes a two-part telescopic rod 52, 53 having a fingered rake tool attachment 54 at one end, a first handle grip 56 with a wrist loop 57, a 90° extension 58 and a second handle grip 59 with a wrist loop 60.

Figure 14:
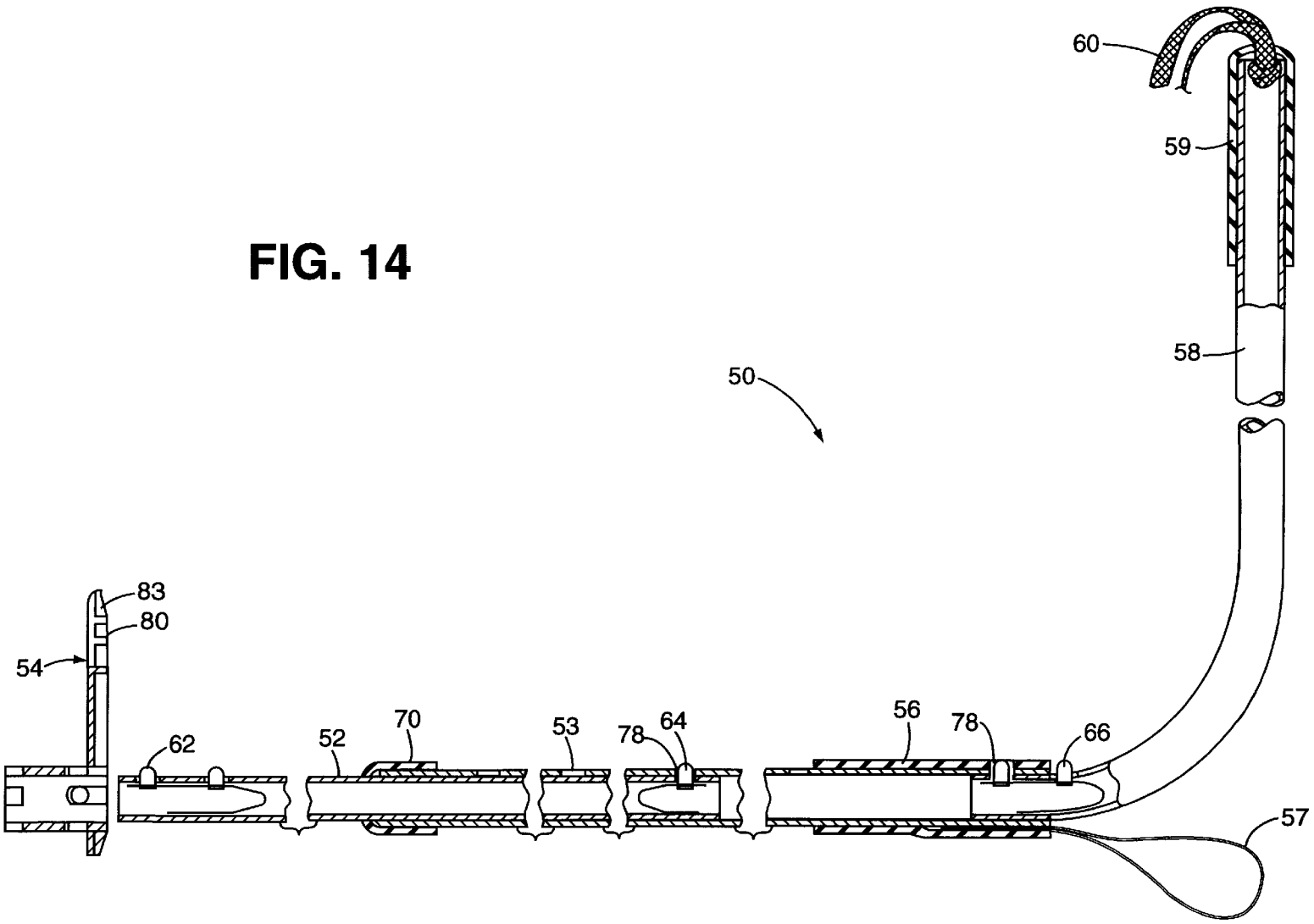
FIG. 14 is a side view of the tool in FIG. 6 with portions broken away.

In the present embodiment as best shown in FIG. 14, the rod members 52, 53 and 58 are made of either aluminum or stainless steel and spring button detent of 62, 64 and 66 are used, respectively, for attachment of the rake head tool 54, telescoping of the rods 52 and 53 and attachment of the 90° handle extension 58. A sleeve cap 70 is positioned on the end of outer rod 53 where inner rod 52 telescopes into the outer rod. Sleeve cap 70 and the handle grips 56 and 59 are preferably a resilient plastic or rubber-like material for providing a firmer grip as well as cushioning when the tool is stowed.

Figure 3:
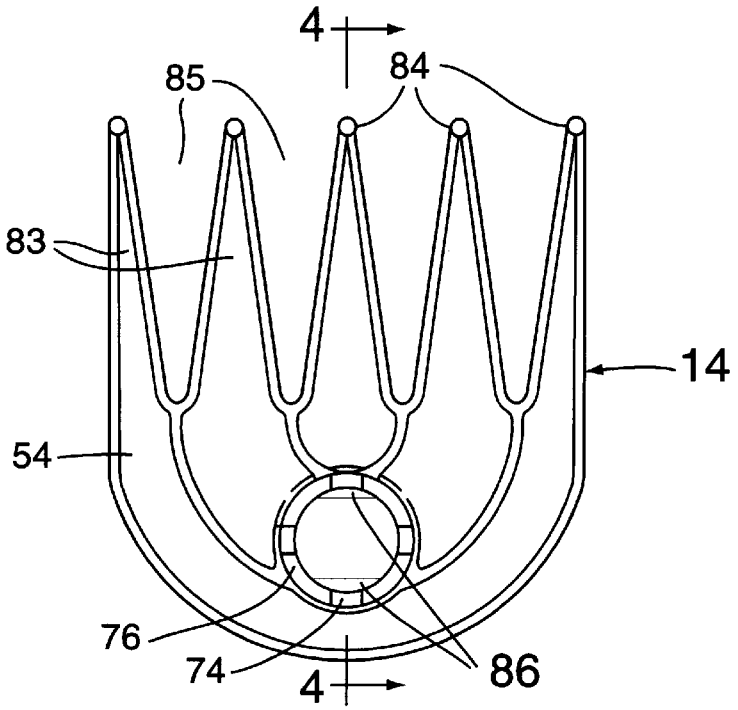
FIG. 3 is a left side view of the tool.
Figure 4:
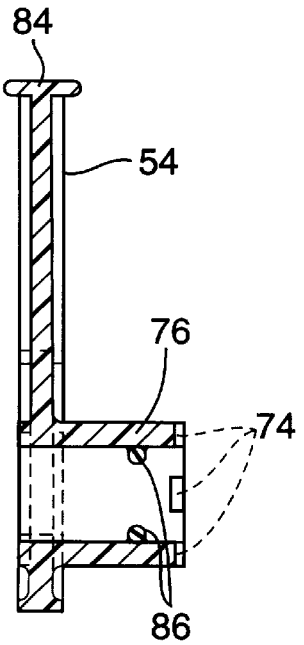
FIG. 4 is a section taken along the line 4—4 in FIG. 3.
Figure 5:
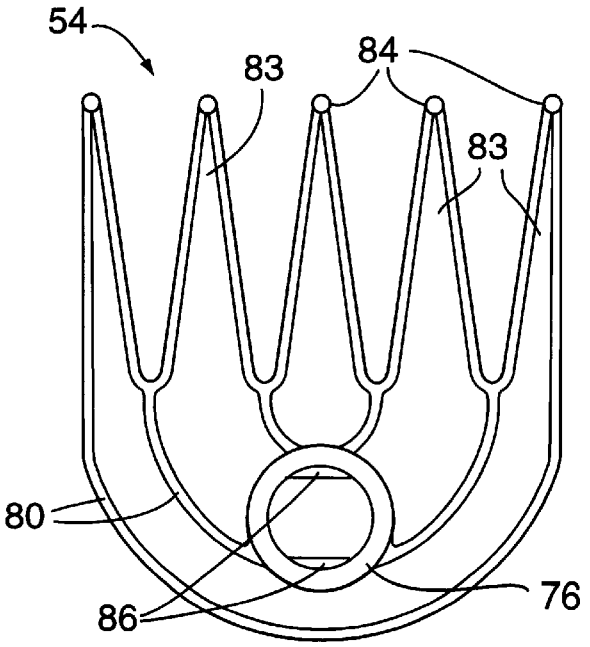
FIG. 5 is a rear elevation view of the rake head attachment.
Figure 6:
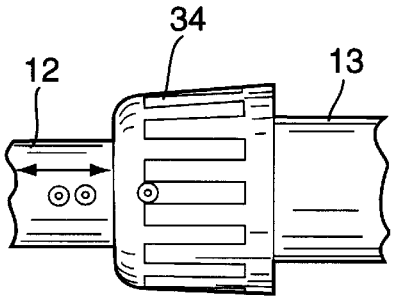
FIG. 6 is a partial side view of the extension connection of the handle in the locked position.
Figure 15:
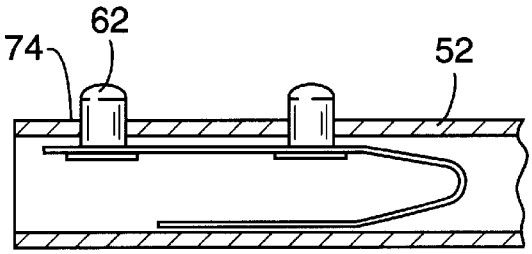
FIG. 15 is an enlarged partial end view in section of the attachment end of the tool.
Figure 16:
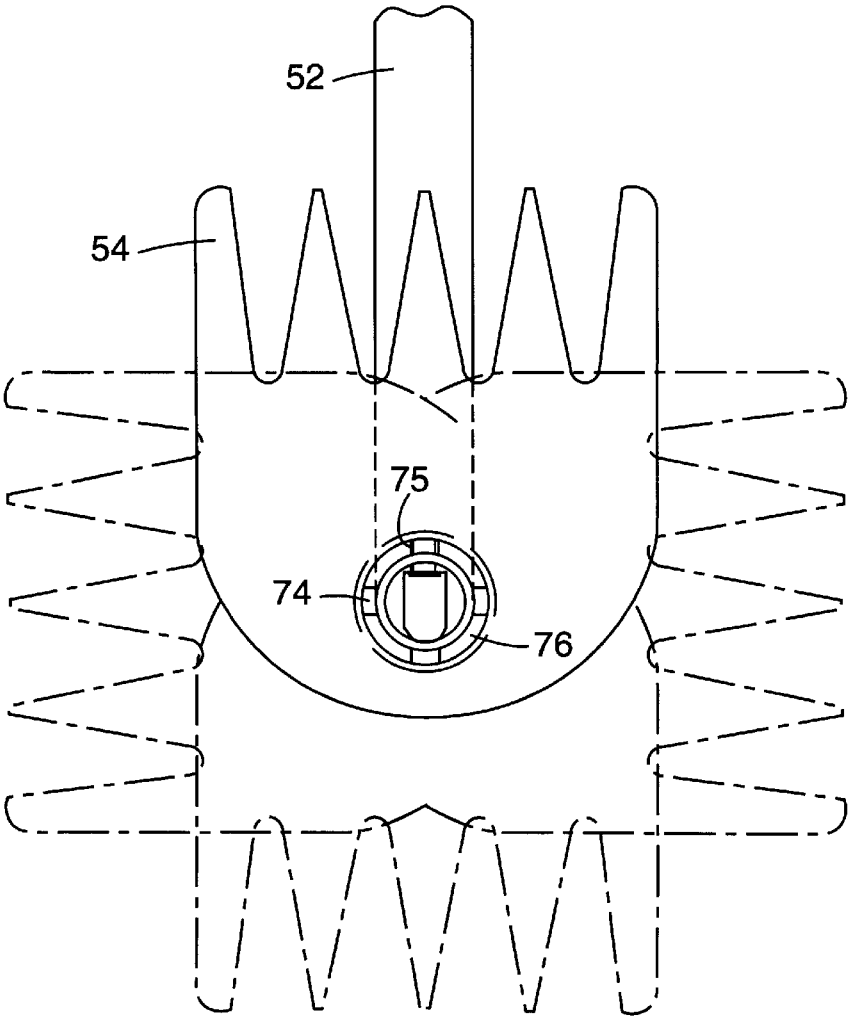
FIG. 16 is a partial end elevation showing the rake head tool attachment in various possible positions.
Figure 17:
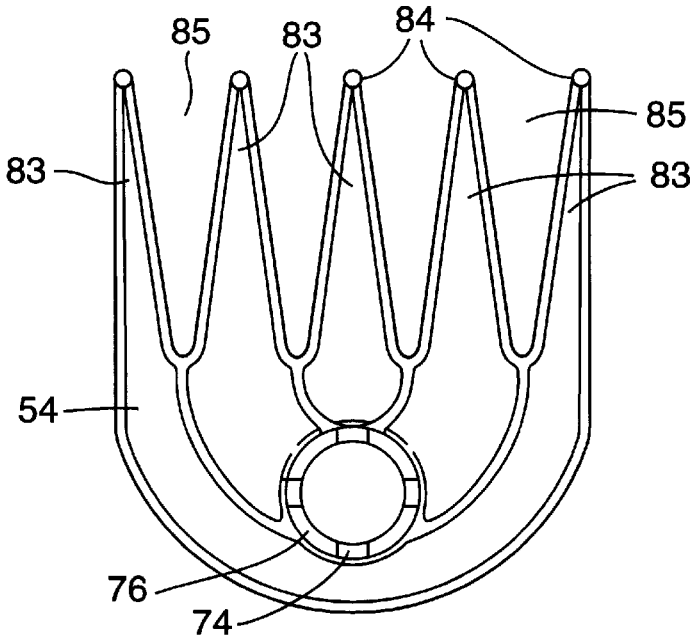
FIG. 17 is a top elevation view of the rake head attachment.
Figure 18:
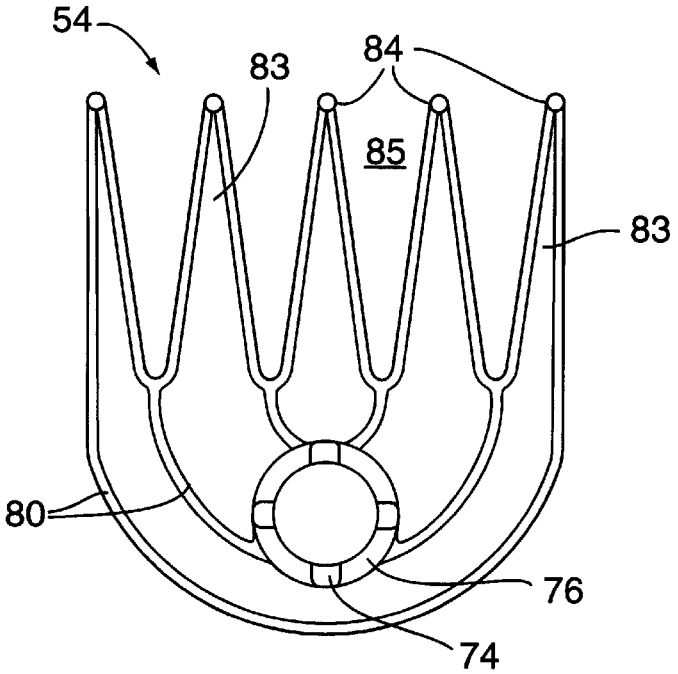
FIG. 18 is a rear elevation view of the rake head attachment.
Figure 19:
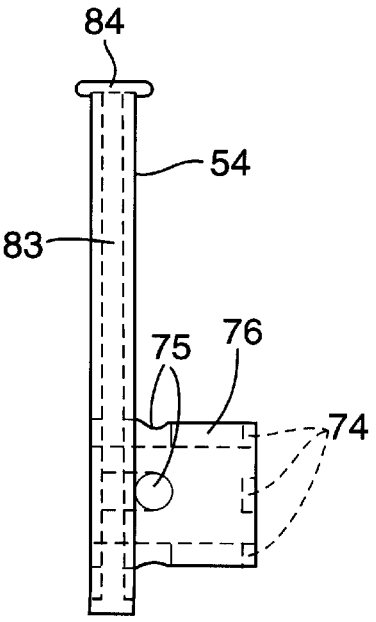
FIG. 19 is a side hidden line view of the rake head shown in FIG. 11.

As shown in FIG. 15 the tool attachment receiving end of rod 52 has a dual push button locking arrangement that works with slots 74 and opening 75 of the tubular fitting 76 of the rake head 54. Additional openings 78 (FIG. 13) on the outer rod 53 enable the rod 52 to be set in a variety of extended and collapsed positions with its push button 64. The particular form of rake head provided is one that can be readily molded of suitable plastic such as black nylon or polypropylene or ABS material with suitable reinforcing ribbing 80 on the underside. In its preferred form, the rake head attachment 54 has approximately 5 evenly-spaced fingers 83 that are generally inverted v-shaped and have barbed tips 84. The gaps 85 between fingers are generally v-shaped openings 85 between the fingers 83. For the screw attachment one or more cross pins 86 is provided in the tubular portion of the head 14 (FIGS. 3–4). When attached to the handle the rake head fingers are disposed substantially perpendicular to the axis of the handle.

It will be appreciated that the tool is quite versatile since different attachment heads may be applied and the handles may be utilized with or without the 90° extension handle 58. Also, handle 58 can be made either unitary as shown in FIG. 23 or can be made of two or more rods for collapsing purposes.

Figure 20:
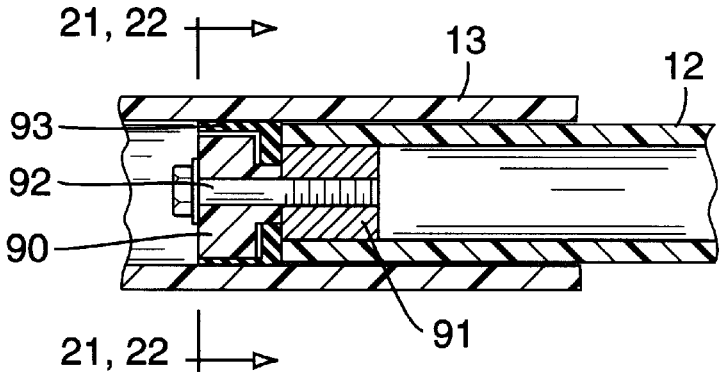
FIG. 20 is a partial longitudinal section view of an alternative extension connection for the handle.
Figure 21:
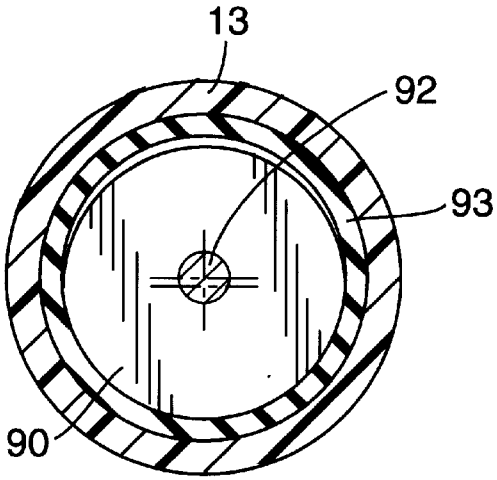
FIG. 21 is a section taken along the line 21—21 in FIG. 20 illustrating an unlocked position.
Figure 22:
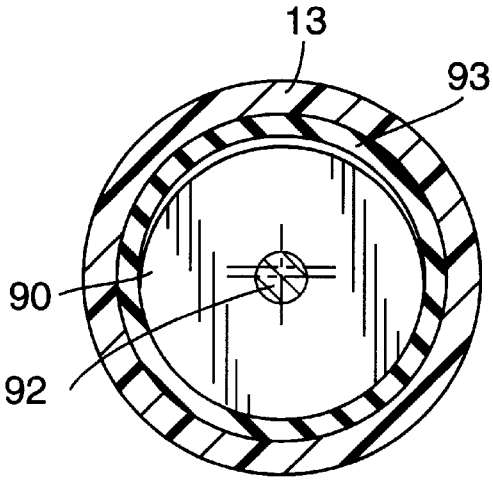
FIG. 22 is a section view similar to FIG. 21, here showing a locked position.

Referring to FIGS. 20–22, there is shown a still further manner of providing telescoping extension handles 12–13 utilizing a cam device 90 connected to the inner handle rod 12. The cam 90 is eccentrically mounted to handle rod 12 with a plug 91 and bolt 92. A resilient sleeve 93 surrounds the cam 90. By relative twisting of the rods 12, 13 in one direction the cam 90 frees the sleeve 93 to allow relative sliding of the rods to expand or telescope (FIG. 21) while twisting the rods in the opposite direction will expand sleeve 93 to lock the rods together in the particular position selected for the handle rods.

Figure 23:
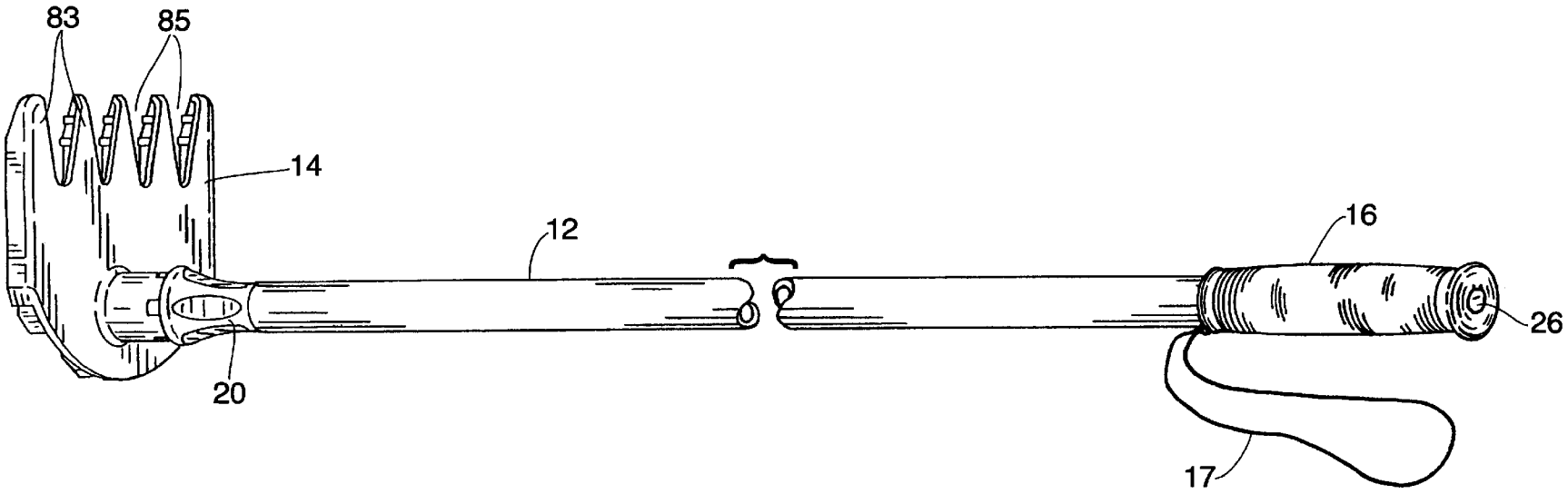
FIG. 23 is a perspective view of an alternative form of tool having a unitary handle.

Referring to FIG. 23, there is shown yet another version of a hollow handle 12 with a rake head 14 and resilient grip 16 which is a unitary handle. This version again will float rather than sink.

Figure 24:
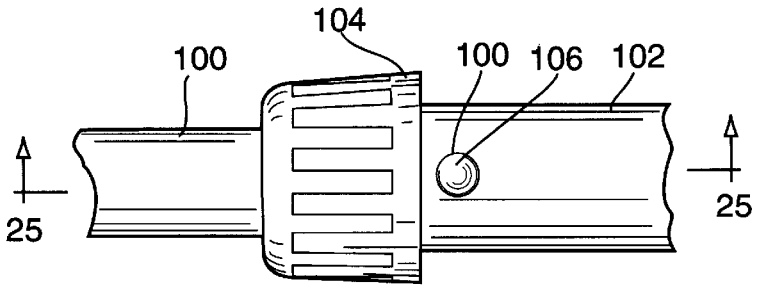
FIG. 24 is a partial end elevation showing another alternative extension detent.
Figure 25:
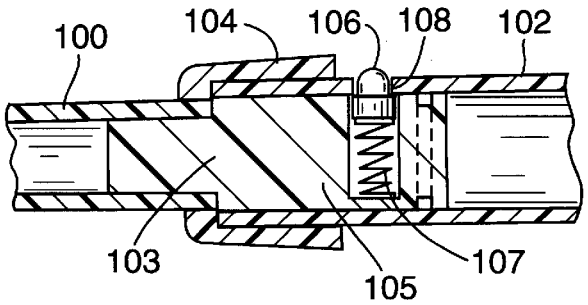
FIG. 25 is a section taken along the line 25—25 in FIG. 24.

As shown in FIGS. 24 and 25 extension of the handle portions 100 and 102 can be done by providing a plug member 103 affixed to the inner telescoping handle part 100.

The outer handle part has an end cap 104 which limits the travel of the handle part 100. The plug 103 carries a button 106 biased outwardly by spring 107. The button 106 coacts with an opening 108 in the outer handle part 102. In the preferred form the handle parts are tubular and made of plastic, however, rectangular components could also be used.

Figure 26:
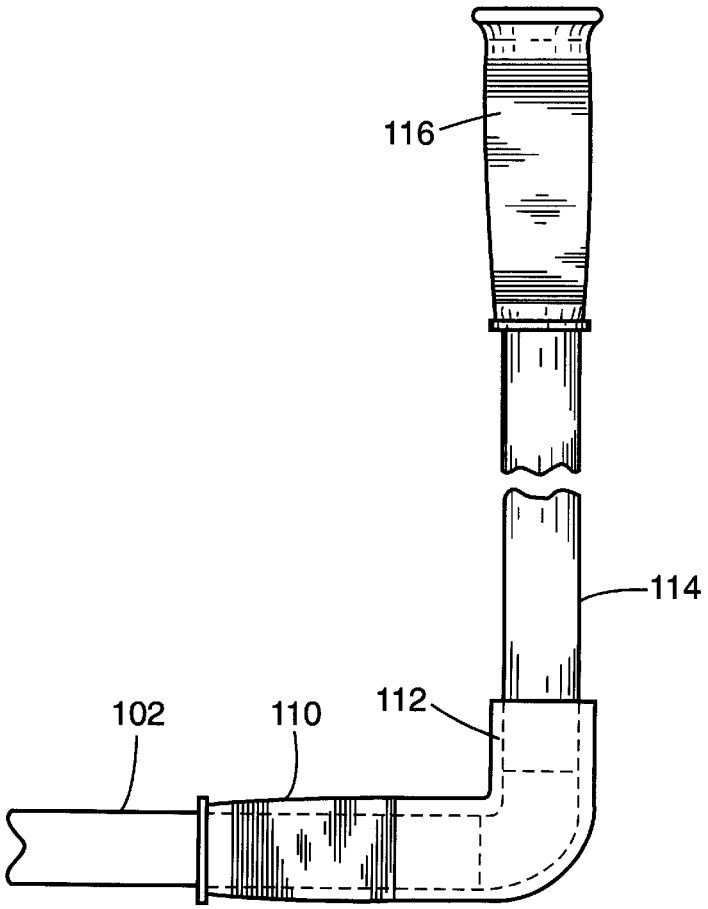
FIG. 26 is a partial side elevation of another 90° extension.

In FIG. 26 there is shown a 90° extension by way of an elbow 112 that receives handle parts 102 and 114 resilient grips 110 and 116 are provided to hold the tools.

What is claimed is:

1. An intake clearing tool for jet-powered aquatic vehicles comprising, in combination, an elongated hollow handle, resilient grip means at one end of the handle, attachment means at the opposite end of the handle, a complimentary attachable finger-type rake head having rake fingers and adapted to attach to the attachment means, said rake fingers being disposed perpendicular to the handle when attached, and said fingers being substantially inverted v-shaped with substantially v-shaped gaps between the fingers, and wherein the handle is sealed at opposite ends to contain an air chamber so that the tool floats.

2. An intake clearing tool as claimed in claim 1 wherein the handle is sealed at opposite ends to contain an air chamber, the resilient grip means at said one end forms the seal and includes a flap valve means and a plug means on the inner part of the handle includes sealing means so that the telescoping action of the handle parts form a suction pump on the extension stroke and a discharge pump on the compression stroke.

3. An intake clearing tool as claimed in claim 2 wherein said plug sealing means is an o-ring.

4. An intake clearing tool as claimed in claim 1 wherein the handle attachment means includes screw threads and wherein the rake head attachment means includes a hub having a through bore and at least one transverse pin that coacts with the threaded attachments means of the handle for securing together.

5. An intake clearing tool as claimed in claim 1 wherein said rake fingers include barbed tips.

6. An intake clearing tool as claimed in claim 1 wherein the handle includes a 90° extension means at the end of the handle opposite to the rake head attachment.

* * * * *